US009487984B2

(12) United States Patent
Wachtell et al.

(10) Patent No.: US 9,487,984 B2
(45) Date of Patent: Nov. 8, 2016

(54) TRAILER OVERHEAD DOOR SYSTEM

(71) Applicant: Cold Chain, LLC, Boise, ID (US)

(72) Inventors: Peter James Wachtell, Boise, ID (US); Daniel Aragon, Meridian, ID (US)

(73) Assignee: COLD CHAIN, LLC, Boise, ID (US)

( * ) Notice: Subject to any disclaimer, the term of this patent is extended or adjusted under 35 U.S.C. 154(b) by 0 days.

(21) Appl. No.: 14/680,726

(22) Filed: Apr. 7, 2015

(65) Prior Publication Data

US 2015/0308175 A1 Oct. 29, 2015

Related U.S. Application Data

(60) Provisional application No. 61/984,400, filed on Apr. 25, 2014.

(51) Int. Cl.

| | |
|---|---|
| ***E05F 15/00*** | (2015.01) |
| ***E05D 13/00*** | (2006.01) |
| *E05D 15/24* | (2006.01) |

(52) U.S. Cl.

CPC ..... *E05D 13/1261* (2013.01); *E05D 15/24* (2013.01); *E05Y 2900/516* (2013.01); *E05Y 2900/532* (2013.01)

(58) Field of Classification Search

CPC ... E05D 13/10; E05D 13/12; E05D 13/1215; E05D 13/1223; E05D 13/1261; E05D 15/10; E05D 15/1002; E05D 15/16; E05D 15/20; E05D 15/24; E05D 15/242; E05Y 2900/516; E05Y 2900/532

USPC ..... 160/191, 189, 190, 192, 113

See application file for complete search history.

(56) References Cited

U.S. PATENT DOCUMENTS

| | | | | |
|---|---|---|---|---|
| 1,508,886 A | | 9/1924 | Dautrick et al. | |
| 1,722,250 A | * | 7/1929 | McKee | E05D 15/24 16/DIG. 31 |
| 1,897,391 A | * | 2/1933 | Kelly | E05D 15/246 16/91 |
| 1,990,870 A | * | 2/1935 | Kelly | E05D 15/246 16/DIG. 31 |
| 1,992,006 A | * | 2/1935 | Greegor | E05D 13/003 16/198 |
| 1,994,142 A | * | 3/1935 | Madsen | E05D 15/24 16/104 |
| 2,020,831 A | * | 11/1935 | Greegor | E05D 13/1261 16/198 |

(Continued)

*Primary Examiner* — Katherine Mitchell
*Assistant Examiner* — Johnnie A Shablack
(74) *Attorney, Agent, or Firm* — Buchanan Nipper LLC

(57) ABSTRACT

A trailer overhead door system for a truck or trailer having a door opening. The trailer overhead door system having a trailer door for enclosing the door opening and a counterbalance system for counterbalancing the trailer door. The counterbalance system including a lifting cable and a return pulley for guiding the lifting cable. The lifting cable attaching between a door top rail, around the return pulley, and back to the counterbalance system.

7 Claims, 7 Drawing Sheets

(56) References Cited

U.S. PATENT DOCUMENTS 2,059,833 A 11/1936 Winn, Jr.
2,124,969 A 7/1938 Bagley et al.
2,171,194 A * 8/1939 Smith ..... E05D 13/1261 16/104
2,257,484 A 9/1941 Rowe
2,607,410 A * 8/1952 McKee ..... E05D 13/1215 160/191
2,630,597 A * 3/1953 Robinson ..... E05D 13/1261 16/198
2,749,570 A 6/1956 Alder
2,786,523 A * 3/1957 Phillips ..... B60J 5/08 160/191
2,882,044 A * 4/1959 Ginte ..... E05F 15/686 160/189
2,923,541 A * 2/1960 Gessell ..... E05F 15/686 160/189
3,021,896 A * 2/1962 Buono ..... E05D 15/24 160/113
3,038,535 A * 6/1962 Stroup ..... E05D 13/1261 16/401
4,082,133 A * 4/1978 Halopoff ..... E05D 13/1223 160/191
4,472,910 A 9/1984 Iha
4,757,853 A * 7/1988 Price ..... E05D 13/1223 160/191
4,860,813 A * 8/1989 Ballyns ..... B60J 5/125 160/188
5,042,556 A 8/1991 Ruiter
5,056,847 A * 10/1991 Stillwell ..... B60J 5/125 160/188
5,135,040 A 8/1992 Ruiter
5,235,724 A 8/1993 Perrin et al.
5,307,855 A 5/1994 Martensson, IV
5,572,829 A * 11/1996 Stoltenberg ..... E05D 15/165 160/191
5,803,149 A * 9/1998 Halley ..... E05F 15/686 160/201
6,089,304 A * 7/2000 Mullet ..... E05D 13/1261 160/193
6,094,779 A 8/2000 Young
6,250,360 B1 * 6/2001 Ochoa ..... E05D 15/24 16/96 R
6,401,793 B1 * 6/2002 Martin ..... E05D 13/1261 160/189
6,561,256 B2 * 5/2003 Mullet ..... E05D 13/1215 160/191
6,742,564 B2 * 6/2004 Martin ..... E05D 13/1261 160/188
6,883,579 B2 * 4/2005 Olmsted ..... E05D 13/00 160/189
6,926,061 B2 * 8/2005 Schulte ..... E05D 13/1215 160/191
6,983,785 B2 * 1/2006 Altimore ..... E05D 13/1238 16/72
7,059,379 B2 6/2006 Lewis, Jr. et al.
7,234,502 B2 * 6/2007 O'Malley ..... E05D 13/1261 160/191
7,372,225 B2 * 5/2008 Murphy ..... E05F 15/686 318/280
7,537,042 B2 * 5/2009 Altimore ..... E05D 13/1238 16/72
8,025,090 B2 * 9/2011 Kicher ..... E05D 13/12 160/191
8,162,026 B1 * 4/2012 Lundahl ..... E05D 13/1261 160/189
8,453,705 B2 * 6/2013 Miller ..... E01F 13/04 160/113
8,528,622 B2 9/2013 Ehrlich
2003/0209333 A1 * 11/2003 Olmsted ..... E05D 13/00 160/189
2008/0295979 A1 * 12/2008 Carlsen ..... E05D 13/1261 160/197
2009/0178339 A1 * 7/2009 Kicher ..... E05D 13/12 49/199
2011/0308744 A1 * 12/2011 Kicher ..... E05D 13/12 160/191
2015/0083348 A1 * 3/2015 Szczygielski ..... E06B 9/0638 160/190
2015/0308175 A1 * 10/2015 Wachtell ..... E05D 15/242 160/191

* cited by examiner

TRAILER OVERHEAD DOOR SYSTEM

PRIORITY/CROSS-REFERENCE TO RELATED APPLICATIONS

This application claims the benefit of U.S. Provisional Application No. 61/984,400, filed 25 Apr. 2014, the disclosure of which is incorporated by reference.

TECHNICAL FIELD

The disclosure generally relates to the field of overhead doors. Particular embodiments relate to overhead doors for trucks and trailers.

BACKGROUND

The use of the term "overhead door" herein means a door which, when opened, assumes a generally horizontal position and, when closed, assumes a generally vertical position, unless the context clearly dictates otherwise. For readability purposes, the term "trailer" will be used generically herein to refer to both trucks and trailers.

Overhead doors used with trailers are often made using multiple rigid panels. These panels are commonly attached using hinges, allowing for the door to operate within curved tracks. Because these overhead doors commonly utilize multiple hinges, they are often very heavy, requiring the use of a counterbalance mechanism.

Counterbalance mechanisms typically utilize a tensioned spring located at the rear of the trailer, directly above the door opening. The tensioned spring is attached to drum rollers, located on each side of the overhead door, via one or more shafts. A pair of lifting cables is wound about the drum rollers and attach to the bottom, or lowest portion, of the overhead door. By attaching the lifting cables to the overhead door, the tensioned spring aides in lifting the overhead door, by the bottom of the door, resulting in less force being needed to open the overhead door.

Overhead doors used with trailers are often made using multiple rigid panels. These multi-panel doors are commonly attached using a plurality of fasteners (e.g., bolts, screws), allowing for the door to operate within curved tracks. Because these overhead doors commonly utilize multiple hinges, they are often very heavy, requiring the use of a counterbalance mechanism. With a multi-panel door, traditionally, the cables attach to the bottom of the door and will thus lift the multi-panel door from its bottom. By lifting the multi-panel door from its bottom, strain on the hinges (and damage to the multi-panel door) is minimized. If such a multi-panel door was to be lifted from its top end portion, the panels would slightly accordion apart as the multi-panel door is lifted—causing damage to the hinges and their connection points with the panels.

SUMMARY OF THE DISCLOSURE

Several exemplary trailer overhead door systems are described herein.

A first exemplary trailer overhead door system comprises a left track and right track extending vertically along a trailer door opening and then horizontally along a portion of the roof. The left track and right track are configured for slidable receipt with a door, via a wheel assembly, allowing the door to traverse between a raised position and closed position.

The first exemplary trailer overhead door system further comprises a counterbalance system having a torsion spring, a shaft, a first cable drum and second cable drum, and a first lifting cable and second lifting cable. Further, the first exemplary trailer overhead door system comprises a first return pulley and a second return pulley. The counterbalance system is configured such that the torsion spring, first cable drum, and second cable drum are connected to the shaft.

The torsion spring is wound to a predetermined tension and the first lifting cable and second lifting cable are then connected to the first cable drum and second cable drum. The first lifting cable and second lifting cable extend in a first direction, about the first return pulley and second return pulley. After encircling the first return pulley and second return pulley, the first lifting cable and second lifting cable return in a second direction and are connected to the top rail of the door.

In this configuration, the torsion spring aides in the lifting of the door such that when the door traverses towards its raised position the torsion spring begins to unwind. Unwinding the torsion spring rotates the shaft, first cable drum, and second cable drum, which, in turn, pulls and winds the first lifting cable and second lifting cable, respectively, about the first cable drum and second cable drum. This exerts an upward-pulling force on the bottom of the door, traversing it to its raised position. Conversely, when the door is lowered, the torsion spring begins to wind. Winding the torsion spring rotates the shaft, first cable drum, and second cable drum in an opposite direction, which, in turn, retracts the first lifting cable and second lifting cable. This allows the door return to its closed position in a slow, safe manner.

Additional understanding of the devices and methods contemplated and/or claimed by the inventors can be gained by reviewing the detailed description of exemplary devices and methods, presented below, and the referenced drawings.

DETAILED DESCRIPTION

The following description and the referenced drawings provide illustrative examples of that which the inventors regard as their invention. As such, the embodiments discussed herein are merely exemplary in nature and are not intended to limit the scope of the invention, or its protection, in any manner. Rather, the description and illustration of these embodiments serve to enable a person of ordinary skill in the relevant art to practice the invention.

The use of "e.g.," "etc," "for instance," "in example," "for example," and "or" and grammatically related terms indicates non-exclusive alternatives without limitation, unless the context clearly dictates otherwise. The use of "including" and grammatically related terms means "including, but not limited to," unless the context clearly dictates otherwise. The use of the articles "a," "an" and "the" are meant to be interpreted as referring to the singular as well as the plural, unless the context clearly dictates otherwise. Thus, for example, reference to "a lifting cable" includes two or more such lifting cables, and the like. The use of "optionally," "alternatively," and grammatically related terms means that the subsequently described element, event or circumstance may or may not be present/occur, and that the description includes instances where said element, event or circumstance occurs and instances where it does not. The use of "preferred," "preferably," and grammatically related terms means that a specified element or technique is more acceptable than another, but not that such specified element or technique is a necessity, unless the context clearly dictates otherwise. The use of "exemplary" means "an example of" and is not intended to convey a meaning of an ideal or preferred embodiment. Words of approximation (e.g., "substantially," "generally"), as used in context of the specification and figures, are intended to take on their ordinary and customary meanings which denote approximation, unless the context clearly dictates otherwise.

The use of "door opening header" means the structural member of a trailer which runs perpendicular to floor which forms the head of the door opening, unless the context clearly dictates otherwise.

The use of "door top rail" means the top end portion of the door, unless the context clearly dictates otherwise. The use of "door top rail" is not intended to be limited to a horizontal cross piece of the door's framework, or a particular surface of the door.

The use of "single membrane door" means a door comprising a single sheet of material, unless the context clearly dictates otherwise.

Figure 1:
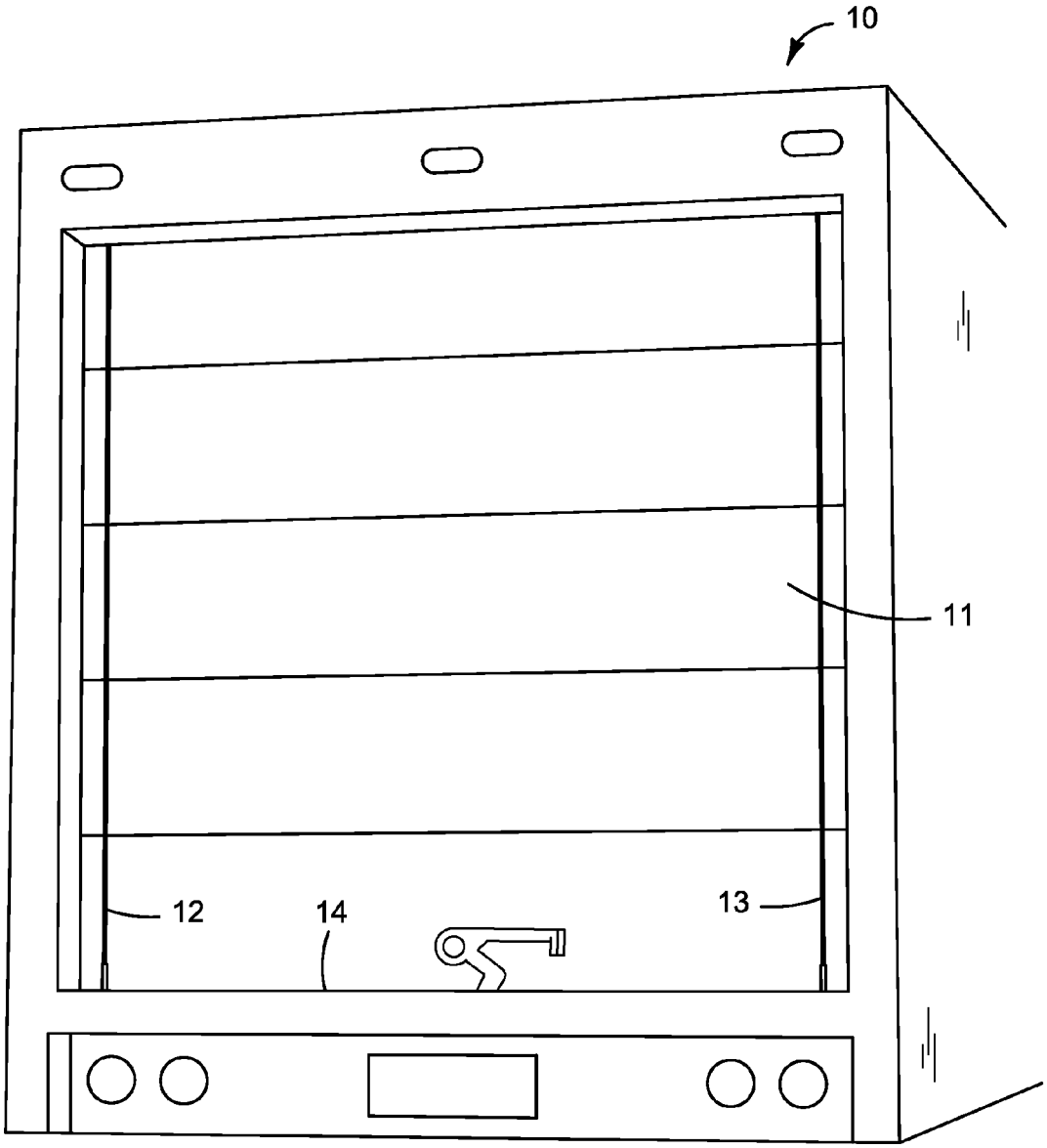
FIG. 1 (Prior Art)
FIG. 1 is a partial, rear perspective view of a prior art trailer having a trailer door.
Figure 2:
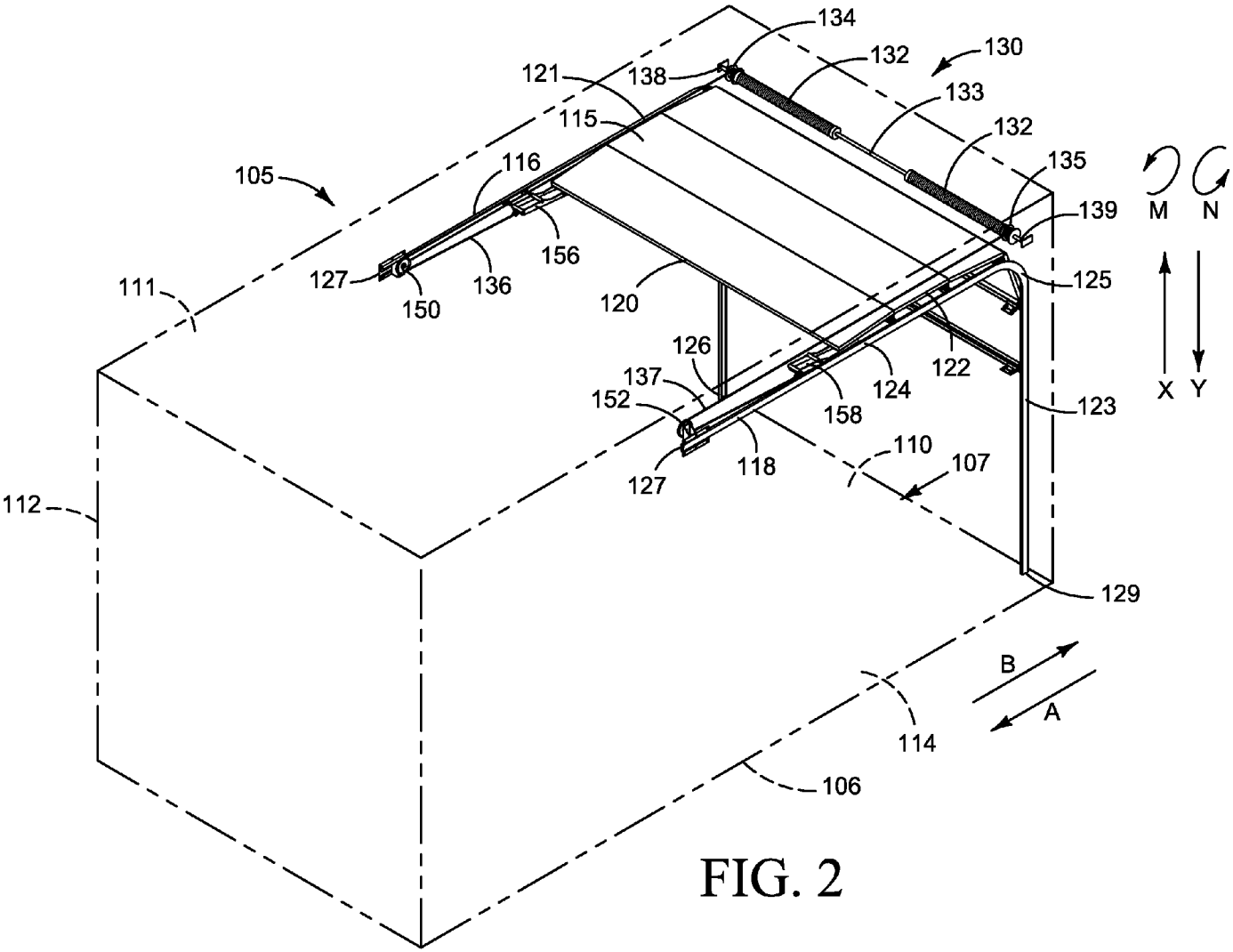
FIG. 2 is a top perspective view of a first exemplary trailer overhead door system.
Figure 3:
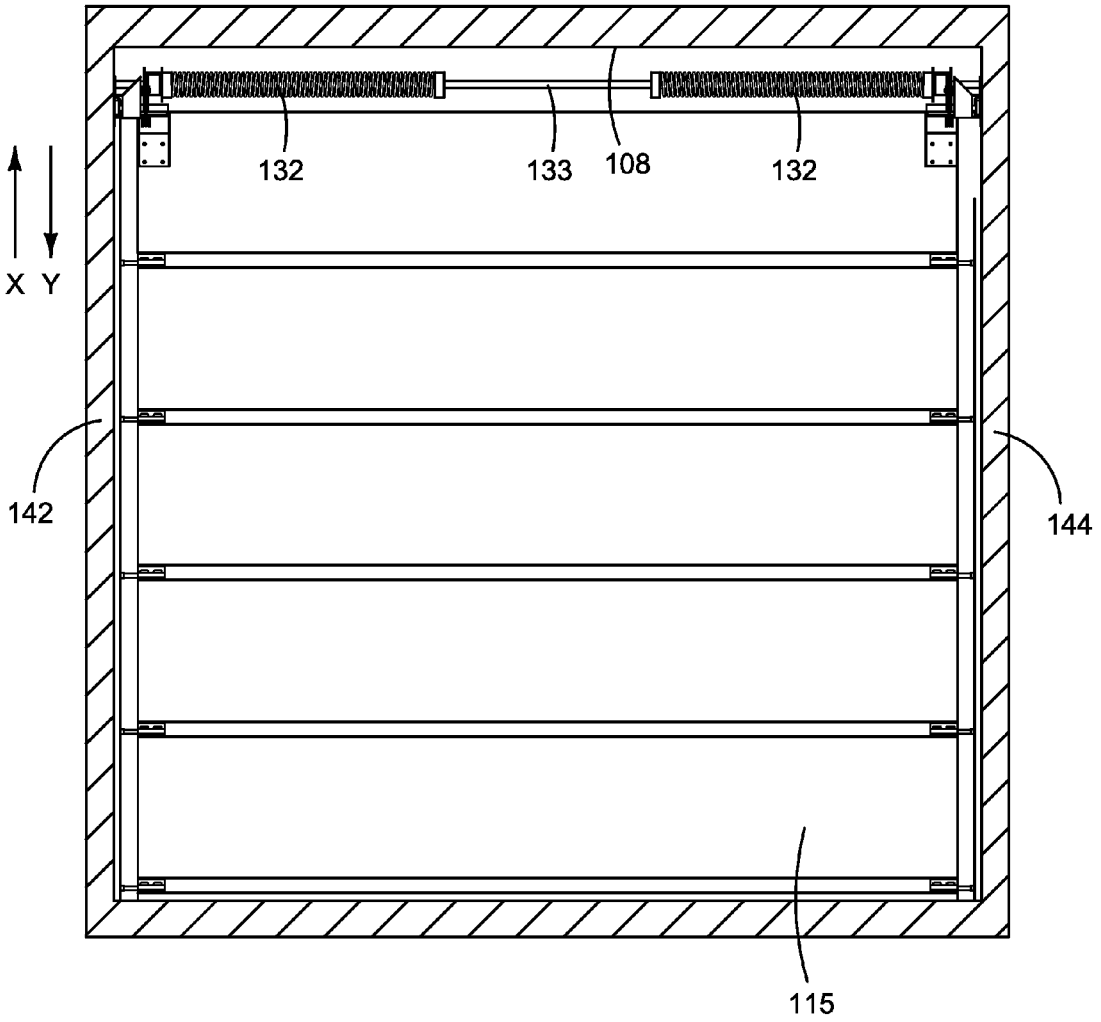
FIG. 3 is a partial, inside view of the first exemplary trailer overhead door system.
Figure 4:
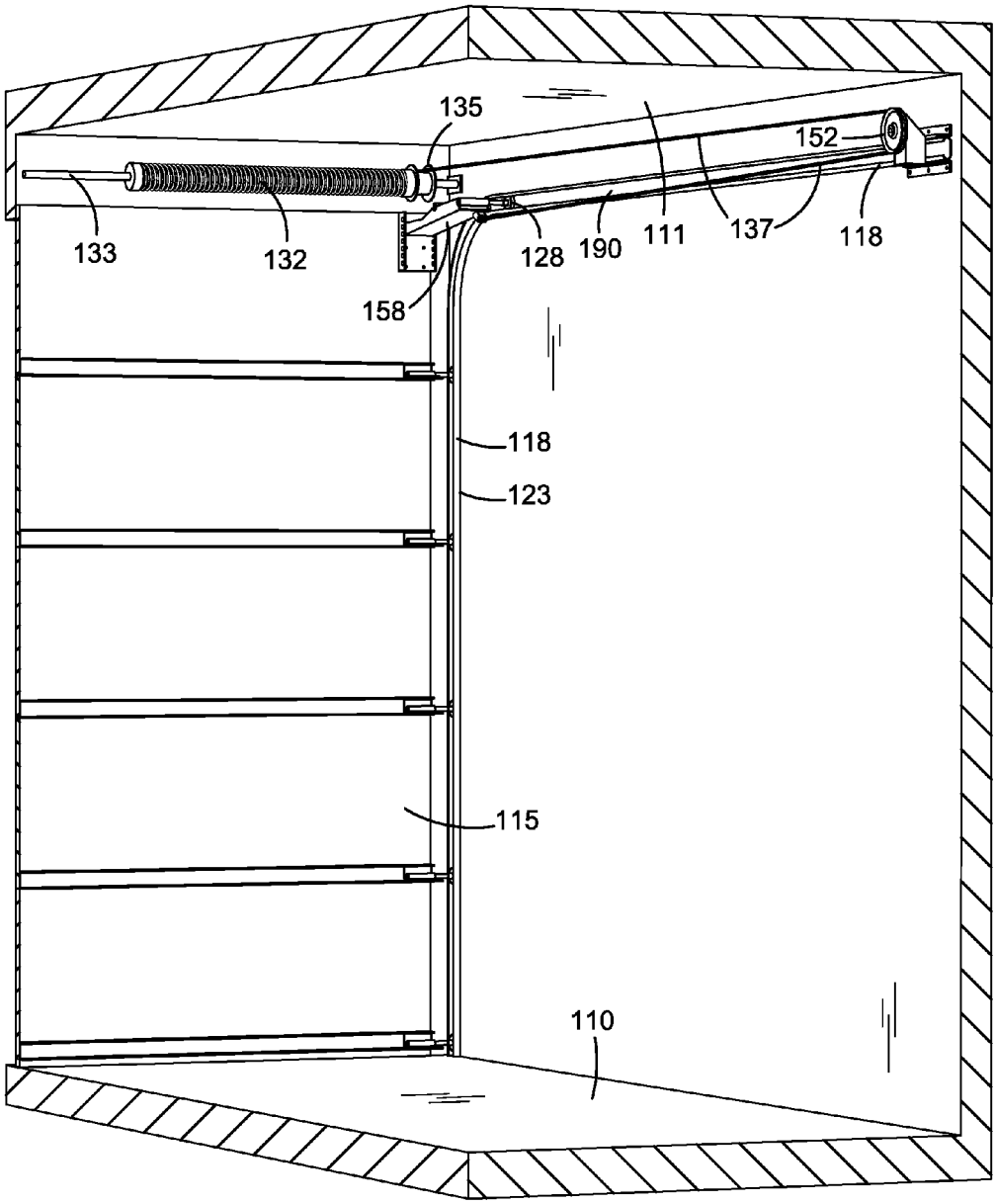
FIG. 4 is a partial, inside perspective view of the first exemplary trailer overhead door system.

Referring initially to FIG. 1, a prior art trailer door system 100 is generally illustrated. The trailer door system 10 having a door 11, a first lifting cable 12, a second lifting cable 13, and a door bottom 14. The first lifting cable 12 and the second lifting cable 13 attach to the door bottom 14. The trailer door system 10 is configured such that the first lifting cable 12 and the second lifting cable 13 are located on the outside of the door 11 when the door 11 is in its closed position, as illustrated in FIG. 1. The door 11 is lifted through the use of a counterbalance system (not illustrated). The counterbalance system utilizes a spring, cable drums, and lifting cables, attached to the bottom of the door, to make the door easier to raise and lower.

Referring next to FIGS. 2 through 7, a first exemplary trailer overhead door system 105 is illustrated in general schematic format. The trailer overhead door system 105 is configured for use on a trailer 106 having a trailer door opening 107 defined in a side thereof. The trailer door opening 107 having a first vertical side 142, a second vertical side 144, and door opening header 108. Further, the trailer 106 comprises a floor 110 opposite a roof 111, a first side wall 112, and second side wall 114. In the trailer 106 illustrated herein, the trailer door opening 107 is in the rear end of the trailer 106. In other exemplary trailer overhead door systems, the opening could be in a different side of the trailer.

The trailer overhead door system 105 comprises a trailer door 115 for closing the trailer door opening 107. The trailer door 115 configured for being opened and closed.

The trailer door 115 illustrated in these figures is mounted on a track system comprising a left track 116 and a right track 118. The left track 116 and right track 118 are configured for slidable receipt of the trailer door 115. The trailer door 115 preferably comprises a plurality of wheel assemblies 128 located on the left vertical side 121 and right vertical side 122 of the trailer door 115. The wheel assemblies 128 are configured engage a first groove 180 and second groove 190 located on the left track 116 and right track 118, allowing the trailer door 115 to slide between a raised position 170 and closed position 172. The trailer door 115 comprises a left vertical side 121 opposing a right vertical side 122, and a door top rail 120 opposing a door bottom rail. Preferably, the left vertical side 121 is slidably mounted on the left track 116 and the right vertical side 122 is slidably mounted on the right track 118.

The trailer door 115 illustrated in the first exemplary trailer overhead door system 105 comprises a multi-panel door. Such multi-panel doors are made of any suitable material, such as vinyl, wood, or metal.

While the exemplary trailer overhead door system described herein is described as a multi-panel door, a skilled artisan will be able to select an appropriate trailer door, such as a single membrane door, for use in a particular embodiment based on various considerations, including the weight of the vehicle, the weight of the intended freight, and the equipment and/or accessories with which the trailer overhead door system is intended to be used, among other considerations.

The trailer door 115 is configured for engaging the left track 116 and right track 118. Preferably, the left track 116 and right track 118 include a vertical portion 123, a horizontal portion 124, and a curved portion 125. The vertical portion 123 begins at a first end 126 of the left track 116 and a first end 129 of the right track 118 and extends in an upward direction X, generally parallel to the first side wall 112 and second side wall 114. The vertical portion 123 extends into the curved portion 125, which then extends into the horizontal portion 124. The horizontal portion 124 extends towards the end of the trailer opposite the side of the trailer in which the trailer door opening 107 is defined, running generally parallel with the roof 111, and terminates at a second end 127.

As described supra, the left track 116 and right track 118 are configured for rolling engagement with a plurality of wheel assemblies 128. The left track 116 and right track 118 each have a groove extending from first end 126 to second end 127, allowing the wheel assemblies 128 to roll within. For example, when the trailer door 115 is raised, the wheel assemblies 128 roll about the vertical portion 123, curved portion 125, and horizontal portion 124, ceasing movement at the second end 127. Conversely, when the trailer door 115 is lowered, the wheel assemblies 128 roll about the horizontal portion 124, curved portion 125, and vertical portion 123, ceasing movement when the trailer door 115 generally rests upon, or is otherwise generally adjacent, the floor 110.

The wheel assemblies 128 of the first exemplary trailer overhead door system 105 are affixed to the left vertical side 121 and right vertical side 122 of the trailer door 115, positioned for insertion into the left track 116 and right track 118. The wheel assemblies 128 are inserted into the first groove 180 and second groove 190, allowing the trailer door 115 to be moved along the left track 116 and the right track 118, from a closed position (illustrated in FIG. 5) to an open position (illustrated in FIG. 6).

Figure 6:
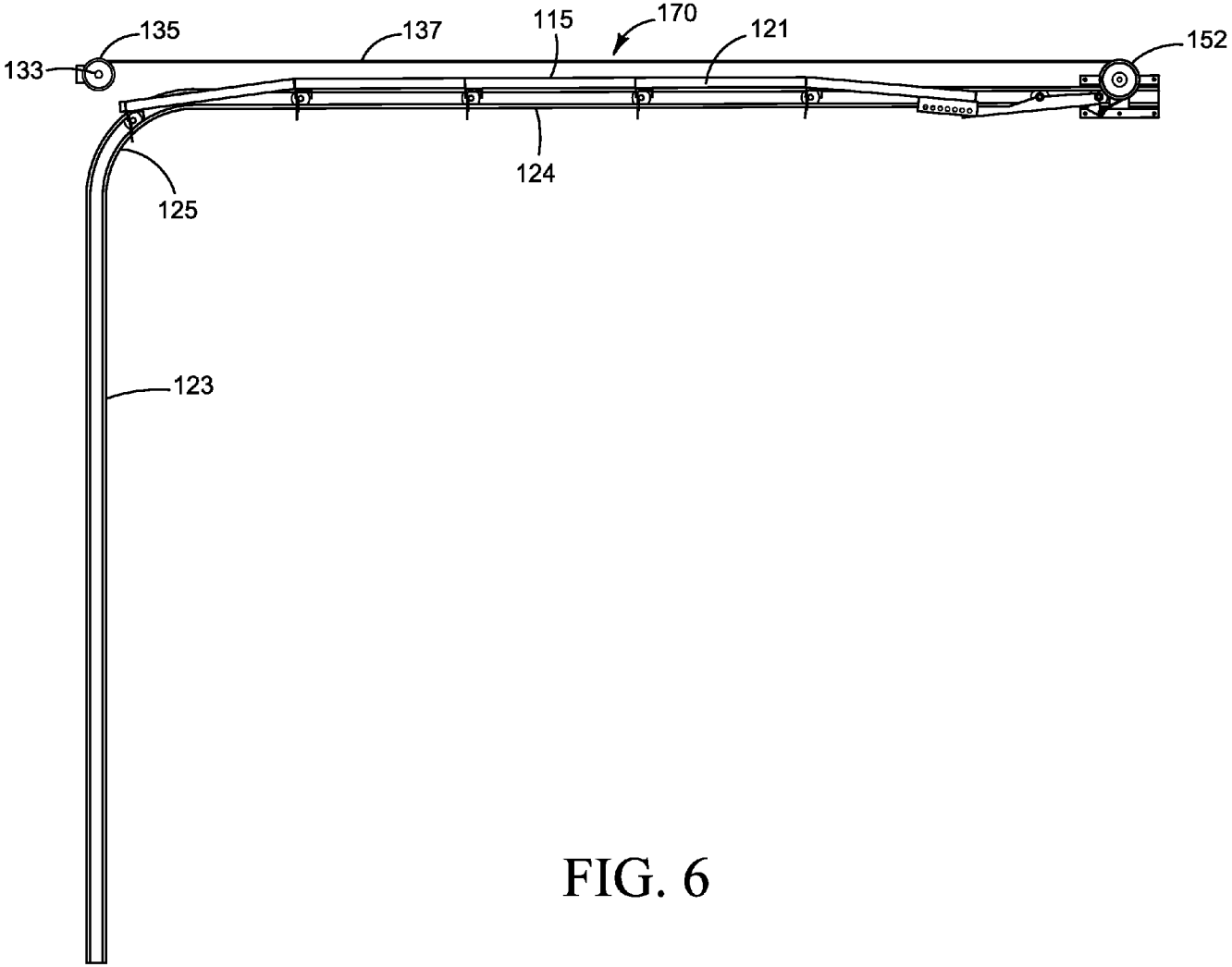
FIG. 6 is a partial, side view of the first exemplary trailer overhead door system illustrating the door in a raised position.
Figure 7:
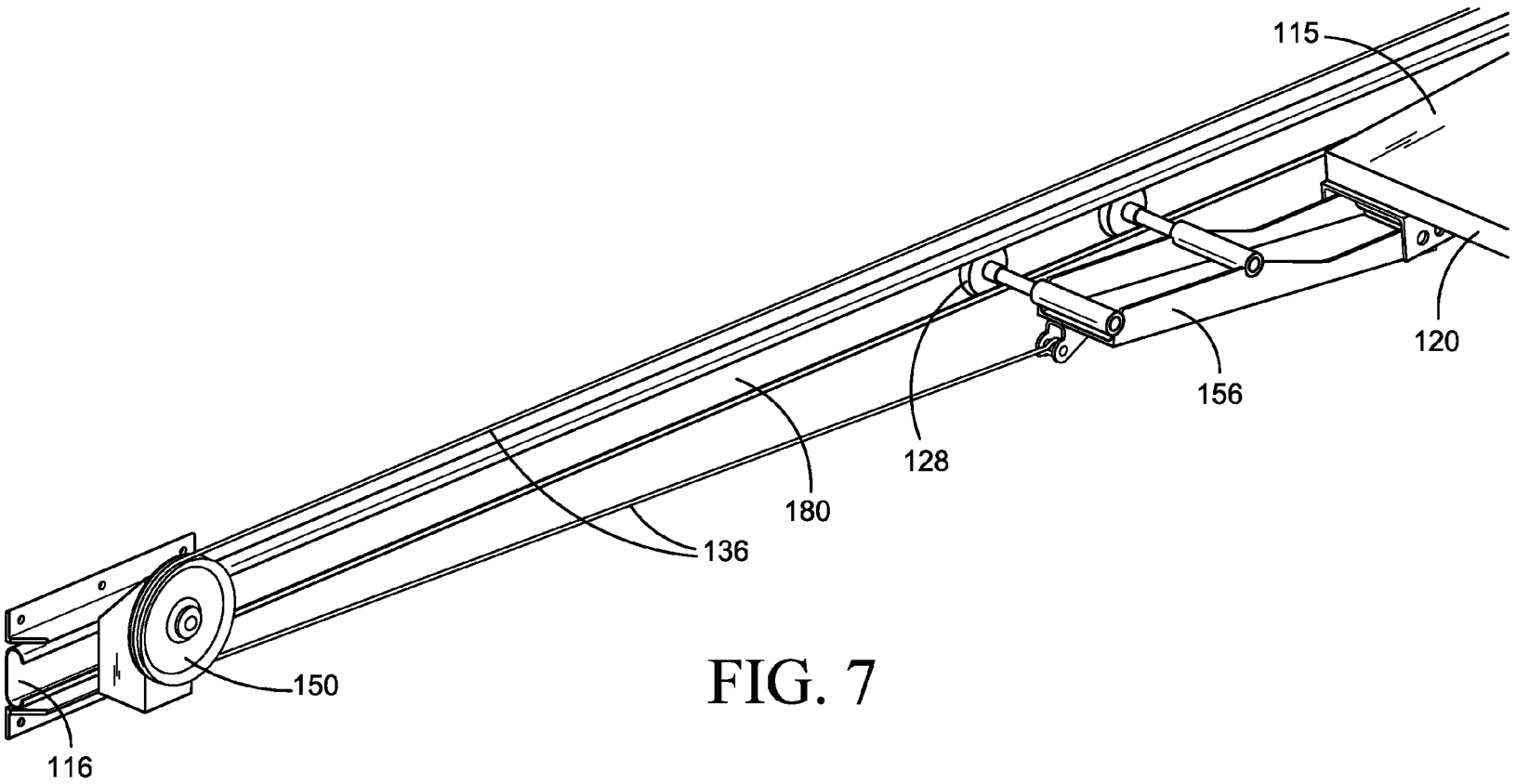
FIG. 7 is a partial, inside perspective view of a first exemplary left track and lifting bracket of the first exemplary trailer overhead door system.

When the trailer door 115 opened (moved from its closed position to its open position), the wheel assemblies 128 traverse along the vertical portion 123 in an upward direction X, about the curved portion 125, and along the horizontal portion 124 in a first direction A. Preferably, the wheel assemblies 128 extend past the second end 127. In this position, most or all of the trailer door 115 is in a generally horizontal position, generally parallel to both the roof 111 and floor 110, as illustrated in FIG. 6.

Figure 5:
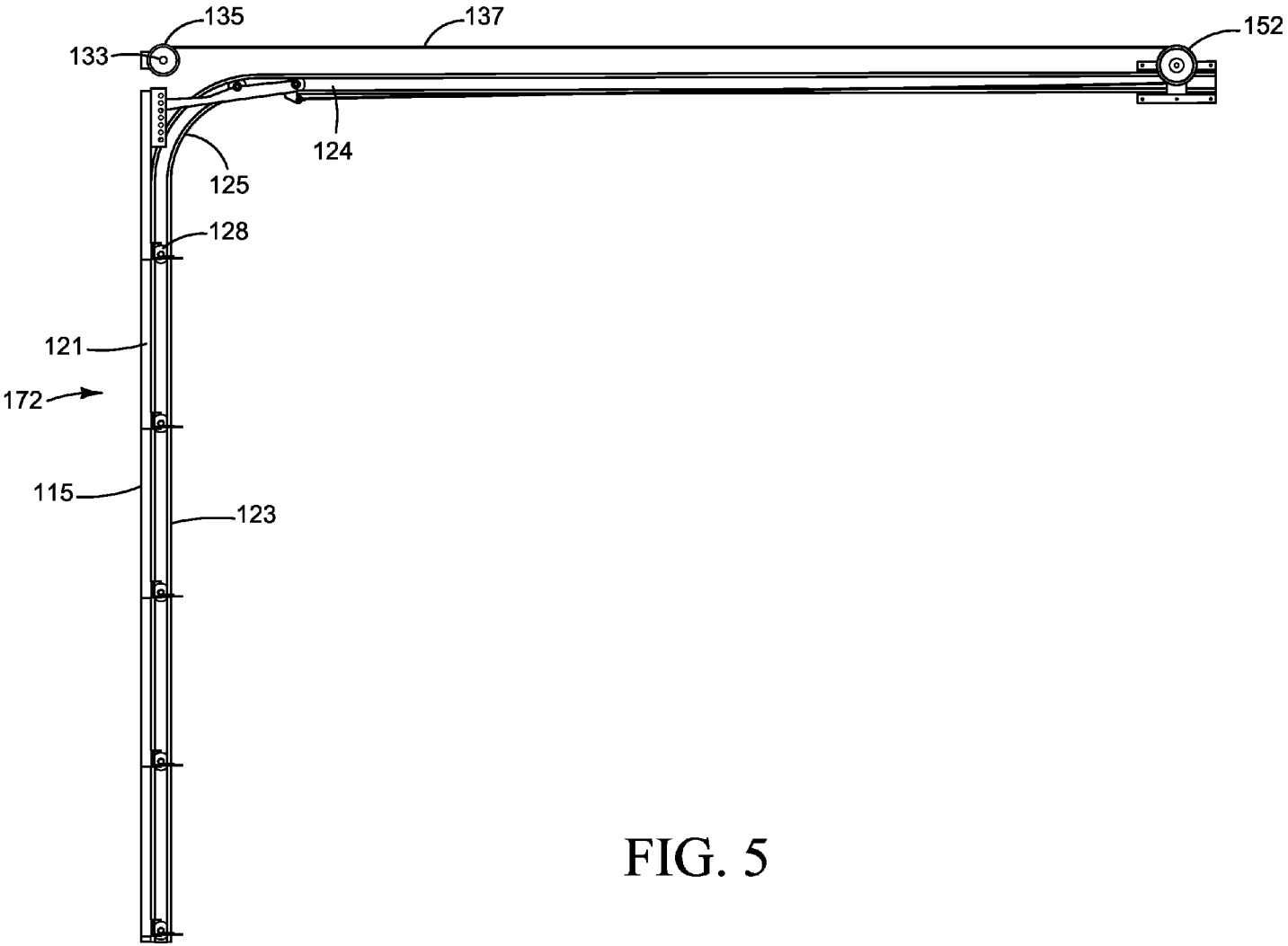
FIG. 5 is a partial, side view of the first exemplary trailer overhead door system illustrating the door in a closed position.

Conversely, when the trailer door 115 is closed (moved from its open position to its closed position), as illustrated in FIG. 5, the wheel assemblies 128 traverse along the horizontal portion 124 in a second direction B, about the curved portion 125, and along the vertical portion 123 in a downward direction Y until the bottom of the trailer door 115 generally rests on the floor 110. In this position, most or all of the trailer door 115 is in a generally vertical position, perpendicular to both the roof 111 and floor 110.

The trailer overhead door system 105 further comprises a counterbalance system 130 for permitting the trailer door 115 to be easily moved from an open position to a closed position, and to positions therebetween.

In the first exemplary trailer overhead door system 105, the trailer door 115 is raised and lowered through the assistance of the counterbalance system 130. The counterbalance system comprises a torsion spring 132, a shaft 133, a first cable drum 134, a second cable drum 135, a first lifting cable 136, a second lifting cable 137, a first return pulley 150, and a second return pulley 152. Generally, the counterbalance system 130 utilizes the shaft 133 and torsion spring 132, wound tightly, to reduce the force required to lift the trailer door 115. A first lifting cable 136 and second lifting cable 137 are attached about the first cable drum 134 and second cable drum 135 and to the door top rail 120 such that when the trailer door 115 is lifted the shaft 133 rotates, pulling the trailer door 115 upward. Conversely, when the trailer door 115 is lowered, the shaft 133 rotates in the opposite direction, assisting in the lowering of the trailer door 115 to its closed position. Such a counterbalance system 130 reduces the force needed to open and close the trailer door 115, making it easier for a user to operate.

Preferably, the counterbalance system 130 is located at the door opening header 108, above the trailer door opening 107. The shaft 133 extends linearly to a first end 138 and second end 139 and is generally rigid in nature. The shaft 133 is mounted such that it is capable of rotation in a first rotational direction M and second rotational direction N, preferably through the use of bearings or other supports.

In the first exemplary trailer overhead door system 105, the torsion spring 132 is connected to and centered upon the shaft 133. Alternatively, multiple torsion springs can be employed, preferably spaced equidistantly about the shaft 133. The torsion spring 132 is wound about the shaft 133 to a predetermined tension, the tension capable of counterbalancing, or offsetting, the weight of the trailer door 115. Thus, when the trailer door 115 is opened, the shaft 133 rotates in a first rotational direction M, causing the torsion spring 132 to release its stored energy, aiding in the lifting of the trailer door 115. Conversely, when the trailer door 115 is closed, the shaft rotates in a second rotational direction N, causing the torsion spring to re-wind itself about the shaft 133.

Attached to the first end 138 and the second end 139 are, respectively, a first cable drum 134 and a second cable drum 135. The first cable drum 134 and the second cable drum 135 are generally circular shaped, extending about the shaft 133. Preferably, the cable drums are spaced equidistant from each other and respectively abut the first end 138 and second end 139 of the shaft. The first cable drum 134 and the second cable drum 135 are attached to the shaft 133 such that when the shaft 133 rotates, the drums, too, rotate.

The first cable drum 134 and second cable drum 135 are configured for attachment with the first lifting cable 136 and second lifting cable 137. The first lifting cable 136 and second lifting cable 137 are attached to the first cable drum 134 and second cable drum 135 such that when the shaft 133 rotates in a first rotational direction M, the first lifting cable 136 and second lifting cable 137 are wound about the first cable drum 134 and second cable drum 135. Conversely, when the shaft 133 rotates in a second rotational direction N, the first lifting cable 136 and the second lifting cable 137 are retracted from the first cable drum 134 and second cable drum 135. The winding and retracting of the first lifting cable 136 and second lifting cable 137 correlates with the opening and closing of the trailer door 115.

The first lifting cable 136 and second lifting cable 137 of the first exemplary trailer overhead door system 105 extend generally horizontally from the first cable drum 134 and second cable drum 135, generally parallel to the roof 111. Preferably, the first lifting cable 136 and second lifting cable 137 comprise steel cables.

The first return pulley 150 and the second return pulley 152 are preferably respectively mounted to the first side wall 112 and second side wall 114, adjacent the second end 127. The first lifting cable 136 and second lifting cable 137 extend horizontally, in a first direction A, from the first cable drum 134 and second cable drum 135. The first lifting cable 136 and second lifting cable 137 run about the first return pulley 150 and second return pulley 152 and back, in a second direction B, attaching to the door top rail 120. Such a configuration requires the first lifting cable 136 and second lifting cable 137 be wound about the first cable drum 134 and second cable drum 135 in an opposite manner to what is commonly known. This allows the first lifting cable 136 and second lifting cable 137 to be located on the inside of the trailer 106, reducing the likelihood of breaking, while still allowing the trailer door 115 to be opened and closed.

After extending about the first return pulley 150 and second return pulley 152, the first lifting cable 136 and the second lifting cable 137 extend back to the trailer door 115 and attach to the door top rail 120. Preferably, such an attachment to the door top rail 120 is via a first lifting bracket 156 and a second lifting bracket 158 which attach to the door top rail 120. In such a configuration, the first lifting cable 136 and the second lifting cable 137 do not extend on the outside surface of the trailer door 115 when the trailer door 115 is in its closed position. Because the first lifting cable 136 and the second lifting cable 137 remain fully inside the trailer 106 when the trailer door 115 is in its closed position 172, the first lifting cable 136 and the second lifting cable 137 are protected from damage and vandalism.

To open the trailer door 115 of the first exemplary trailer overhead door system 105, a user first extends the trailer door 115 in an upward direction X. As the wheel assembly 128 moves along the vertical portion 123, the shaft 133 rotates in a first rotational direction M. As the shaft 133 rotates, the torsion spring 132 unwinds, aiding the lifting of the trailer door 115. Further, the first cable drum 134 and second cable drum 135 rotate, pulling the first lifting cable 136 and second lifting cable 137 in a second direction B. As the first lifting cable 136 and second lifting cable 137 are pulled, the first lifting cable 136 and second lifting cable 137 are wound about the first cable drum 134 and second cable drum 135. The first return pulley 150 and second return pulley 152 allow the trailer door 115 to be pulled from door top rail 120. This process continues, as the wheel assembly 128 traverses in an upward direction X through the vertical portion 123, through the curved portion 125, and in a first direction A through the horizontal portion 124. The trailer door 115 is in a raised position 170, generally horizontal to the floor 110, when the wheel assembly 128 reaches the second end 127.

Conversely, to close the trailer door 115, a user retracts the trailer door 115 in a downward direction Y. This rotates the shaft 133 in a second rotational direction N. As the shaft 133 rotates, the torsion spring 132 winds, aiding the closing of the trailer door 115. Further, the first cable drum 134 and second cable drum 135 rotate, extending the first lifting cable 136 and second lifting cable 137 in a first direction A. As the first lifting cable 136 and second lifting cable 137 are extended, the trailer door 115 is slowly lowered through the use of the first return pulley 150 and second return pulley 152. This process continues, as the wheel assembly 128 traverses in a second direction Y through the horizontal portion 124, through the curved portion 125, and in a downward direction Y through the vertical portion 123. The trailer door 115 is in a closed position 172, generally perpendicular to the floor 110, when the trailer door 115 rests generally upon the floor 110.

A second exemplary trailer overhead door system (not illustrated) is similar to the first exemplary trailer overhead door system illustrated in FIGS. 2 through 7 and described above, except as detailed below. Thus, the second exemplary trailer overhead door system includes a single membrane door. Such a single membrane door employs a flexible membrane made of any suitable flexible material, such as cloth, plastic, or rubber sheeting. Optionally, flexible covers can be employed in various locations about the trailer door. However, it is preferable that the flexible membrane and flexible covers be a single integral piece of flexible material.

A third exemplary trailer overhead door system (not illustrated) is similar to the first exemplary trailer overhead door system illustrated in FIGS. 2 through 7 and described above, except as detailed below. Thus, the second exemplary trailer overhead door system includes at least two return pulleys, the return pulleys mounted to the trailer roof.

A fourth exemplary trailer overhead door system (not illustrated) is similar to the first exemplary trailer overhead door system illustrated in FIGS. 2 through 7 and described above, except as detailed below. Thus, the second exemplary trailer overhead door system includes a single return pulley, single cable drum, and single lifting cable, the cable drum centered about the shaft.

The first exemplary method of retrofitting an existing trailer door with a trailer overhead door system comprises the steps of: disconnecting lifting cables from the bottom of the trailer door, mounting return pulleys inside the trailer adjacent the ends of the door's tracks, extending the lifting cables around the return pulleys, and connecting the lifting cables to the top door rail of the door.

It is noted that all structure and features of the various described and illustrated embodiments can be combined in any suitable configuration for inclusion in a trailer overhead door system according to a particular embodiment. For example, a trailer overhead door system according a particular embodiment can include one or more of the lifting cables and the cable drums described above.

Furthermore, any suitable structures and/or materials can be used for the overhead door system, and a skilled artisan will be able to select an appropriate structure and material in a particular embodiment based on various considerations, including the intended use of the system, the intended arena within which the system will be used, and the equipment and/or accessories with which the system is intended to be used, among other considerations.

The foregoing detailed description provides exemplary embodiments of the invention and includes the best mode for practicing the invention. The description and illustration of these embodiments is intended only to provide examples of the invention, and not to limit the scope of the invention, or its protection, in any manner.

What is claimed is:

1. A trailer overhead door system for a trailer having a door opening, a floor opposite a roof, and a first side wall opposite a second side wall, and a door opening header above said door opening, the trailer overhead door system comprising:

a trailer door for enclosing said door opening, said trailer door comprising a door top rail, a left vertical side and a right vertical side;

a left track for slidable receipt with said left vertical side of the door, said left track extending along said first vertical side of said door opening and along a portion of the roof of the trailer;

a right track for slidable receipt with said right vertical side of the door, said right track extending along said second vertical side of said door opening and along a portion of the roof of the trailer;

a counterbalance system for maintaining said trailer door in an open position, closed position, and positions therebetween, said counterbalance system comprising at least one spring, a shaft, at least one cable drum, and at least one lifting cable, said lifting cable comprising a first end and a second end; and at least one return pulley for guiding said lifting cable, wherein said first end of said lifting cable runs generally parallel to said roof and is connected to said door top rail, wherein said lifting cable extends around said return pulley, and wherein said second end of said lifting cable connects to said at least one cable drum.

2. The trailer overhead door system of claim 1, wherein said trailer door comprises a single membrane trailer door.

3. The trailer overhead door system of claim 1, wherein said first end of said lifting cable is connected to said door top rail via at least one lifting bracket.

4. The trailer overhead door system of claim 3, wherein said trailer door comprises a single membrane trailer door.

5. A trailer overhead door system for a trailer having a door opening, a floor opposite a roof, and a first side wall opposite a second side wall, said door opening having a pair of vertical sides and a door opening header above said door opening, the trailer overhead door system comprising:

a single membrane trailer door for enclosing said door opening, said trailer door comprising a door top rail, a left vertical side and a right vertical side;

a left track for slidable receipt with said left vertical side of the door, said left track is curved and extends from a first proximal end adjacent said first side wall and then horizontally along a portion of said roof to a first distal end;

a right track for slidable receipt with said right vertical side of the door, said right track is curved and extends from a second proximal end adjacent said second side wall and then horizontally along a portion of said roof to a second distal end;

a counterbalance system for maintaining said single membrane trailer door in an open position, closed position, and positions therebetween, said counterbalance system comprising at least one torsion spring, a shaft, at least one cable drum, and at least one lifting cable, said lifting cable comprising a first end and a second end; and at least one return pulley for guiding said lifting cable, wherein said torsion spring is wound about said shaft and said cable drum is attached to said shaft, said first end of said lifting cable is attached to said cable drum, said second end of said lifting cable extends in a first direction about said return pulley, then in a second direction, attaching to said door top rail of the single membrane door.

6. The trailer overhead door system of claim 5, wherein said second end of said lifting cable is connected to said door top rail via at least one lifting bracket.

7. A trailer overhead door system for a trailer having a door opening, a floor opposite a roof, and a first side wall opposite a second side wall, said door opening having a pair of vertical sides and a door opening header above said door opening, the trailer overhead door system comprising:

a single membrane door for enclosing said door opening, said trailer door comprising a door top rail, a left vertical side and a right vertical side, said door top rail further comprising a first lifting bracket and a second lifting bracket;

a left track for slidable receipt with said left vertical side of the door, said left track is curved and extends from a first proximal end adjacent said first vertical side and then horizontally along a portion of said roof to a first distal end;

a right track for slidable receipt with said right vertical side of the door, said right track is curved and extends from a second proximal end adjacent said second vertical side and then horizontally along a portion of said roof to a second distal end;

a counterbalance system for maintaining said trailer door in an open position, closed position, and positions therebetween, said counterbalance system comprising a torsion spring, a shaft, said shaft further comprising a first end and second end, a first cable drum and second cable drum, and a first lifting cable and second lifting cable, said first lifting cable further comprising a first end and second end, said second lifting cable further comprising a first end and second end;

a first return pulley for guiding said first lifting cable; and a second return pulley for guiding said second lifting cable, wherein said torsion spring is wound about said shaft, said first cable drum is attached to said first end of the shaft, said second cable drum attached to said second end of the shaft, said first end of the first lifting cable is attached to the first cable drum, said second end of the first lifting cable extends in a first direction about the first return pulley, then in a second direction, wherein the first lifting cable attaches to said first lifting bracket, said first end of the second lifting cable is attached to the second cable drum, said second end of the second lifting cable extends in a first direction about the second return pulley, then in a second direction, wherein the second lifting cable attaches to said second lifting bracket.

* * * * *